US007460646B2

(12) United States Patent
Zink

(10) Patent No.: US 7,460,646 B2
(45) Date of Patent: Dec. 2, 2008

(54) DEVICE FOR AND METHOD OF GENERATING EXTREME ULTRAVIOLET AND/OR SOFT-X-RAY RADIATION BY MEANS OF A PLASMA

(75) Inventor: Peter Zink, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 332 days.

(21) Appl. No.: 10/548,966

(22) PCT Filed: Mar. 9, 2004

(86) PCT No.: PCT/IB2004/050213

§ 371 (c)(1),
(2), (4) Date: Sep. 12, 2005

(87) PCT Pub. No.: WO2004/084592

PCT Pub. Date: Sep. 30, 2004

(65) Prior Publication Data

US 2006/0203965 A1 Sep. 14, 2006

(30) Foreign Application Priority Data

Mar. 18, 2003 (EP) ..... 03100681

(51) Int. Cl.
*H01J 35/08* (2006.01)

(52) U.S. Cl. ..... 378/143; 250/504 R

(58) Field of Classification Search ..... 378/119, 378/143; 250/504 R, 493.1
See application file for complete search history.

(56) References Cited

U.S. PATENT DOCUMENTS

| | | | | |
|---|---|---|---|---|
| 4,723,262 | A | 2/1988 | Noda et al. | |
| 5,270,542 | A | 12/1993 | McMurry et al. | |
| 5,991,360 | A | 11/1999 | Matsui et al. | |
| 6,075,838 | A | 6/2000 | McGeoch | |
| 6,507,641 | B1 * | 1/2003 | Kondo et al. | 378/119 |
| 6,647,088 | B1 * | 11/2003 | Schmidt et al. | 378/34 |

FOREIGN PATENT DOCUMENTS

| | | | |
|---|---|---|---|
| EP | 1109427 | * | 6/2001 |
| EP | 1367441 | * | 12/2003 |
| WO | WO200130122 | * | 4/2001 |
| WO | WO200131678 | * | 5/2001 |

* cited by examiner

*Primary Examiner*—Hoon Song

(57) ABSTRACT

A method for generating extreme ultraviolet and/or soft X-ray radiation by a plasma that can be generated through irradiation of a material. In order to obtain a reduction in the contamination of an optical illumination system as well as an instantaneous optimization of the power of a radiation source, at least a quantity of the material is controlled by a blocking device.

32 Claims, 4 Drawing Sheets

Figure 1:
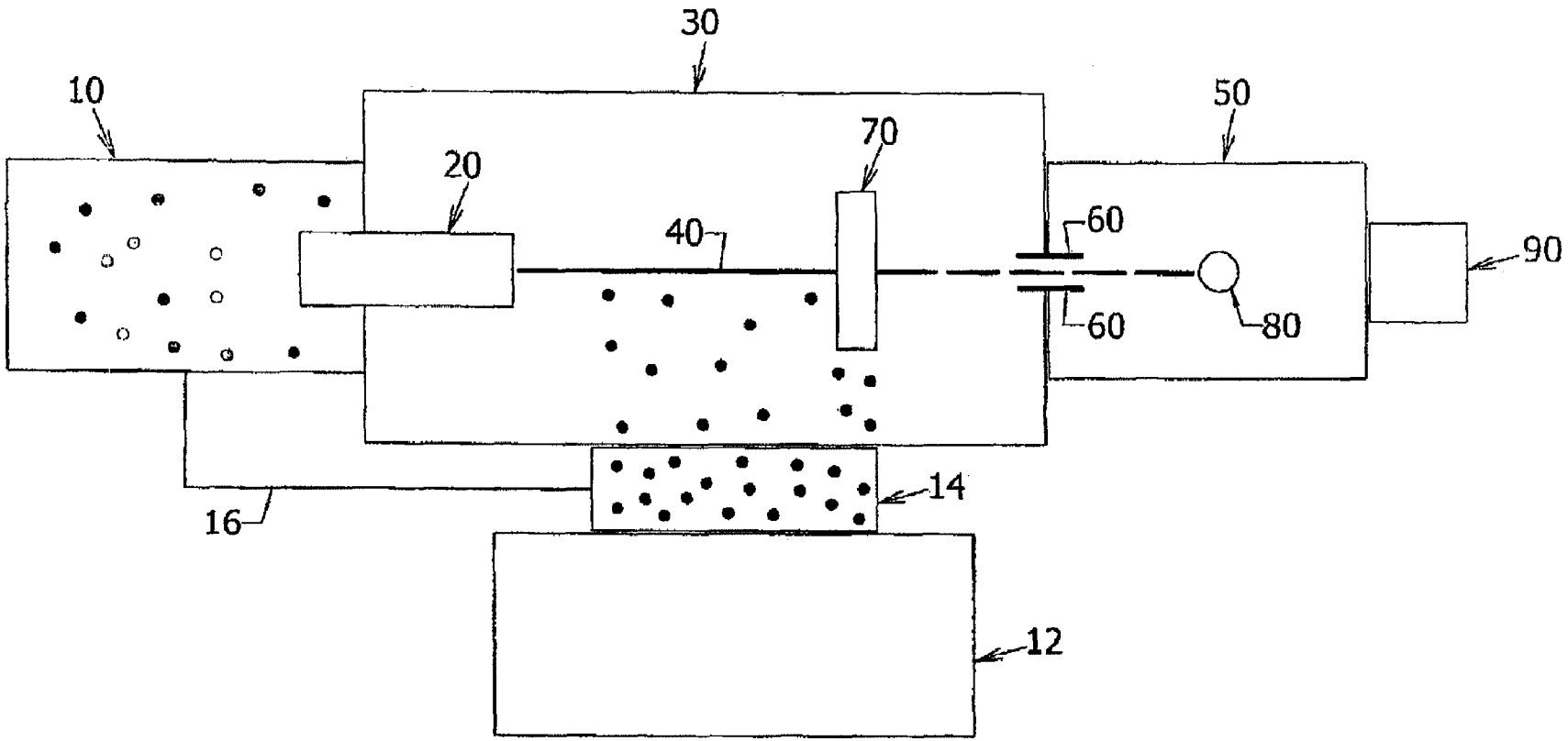

DEVICE FOR AND METHOD OF GENERATING EXTREME ULTRAVIOLET AND/OR SOFT-X-RAY RADIATION BY MEANS OF A PLASMA

The invention relates to a device for and a method of generating extreme ultraviolet and/or soft X-ray radiation by means of a plasma which can be generated through irradiation of a material.

Such methods and devices are known. The extreme ultraviolet radiation, EUV radiation for short, is required, for example, for the next generation of lithography equipment in the semiconductor industry. A high-intensity light source in the short wavelength range is necessary in particular for the further miniaturization of integrated circuits on a so-called wafer. Wavelengths in the range of 13.5 nm are particularly selected, because corresponding multilayer reflectors are available for this spectral range. To guarantee a high throughput in a production of wafers, the intensity of a radiation source must be high. Approximately 50 to 150 W power in the extreme ultraviolet light range must be available at the input side of an optical illumination system. To make this power of the radiation source available, an efficient transformation of the supplied energy into EUV radiation is necessary. In addition, the radiation must be monochromatic as much as possible so as to comply with the high requirements imposed on the optical illumination system. Finally, the useful life of the entire system is of major importance. It is especially the very expensive optical illumination system that is sensitive to contamination. For this reason all fragments and gases originating from the radiation source must be minimized.

Two kinds of extreme ultraviolet light-emitting radiation sources are mainly in use for lithography, i.e. laser-generated plasmas and discharge plasma sources.

When a laser is used, the plasma is formed by an intensive, well-focused laser beam which hits a solid or liquid material. The extreme ultraviolet radiation is emitted by the highly ionized species of the material. This material may either be solid or liquid. It is usually formed by metal particles or by substances solidified by cryogenic techniques, such as xenon which condenses owing to expansion through small nozzles. The main problem in this technique is the requirement of an intensive laser beam. Such lasers are not yet available at the moment and would be very expensive, were their manufacture possible at all. Further problems are erosion of the nozzles, which come very close to the laser spot that forms the plasma, and fragments coming from the nozzles or from the evaporating larger material particles.

A hot plasma may also be formed by a discharge. Quickly rising discharge currents lead to strong magnetic fields which contract the charge carriers under formation of a narrow, dense, hot plasma which emits EUV radiation. Various kinds of discharges such as capillary discharges, focusing plasma discharges, and discharges triggered by a hollow cathode are known. Xenon is mostly used as the operational gas for the discharge nowadays. It is easy to handle, being a rare gas, and a highly ionized species of the xenon has a radiation transition at 13.5 nm.

There are indications, however, that some materials have a higher conversion efficacy for the generation of radiation at 13.5 nm. Thus, for example, lithium has a strong emission line at this energy level. Tin ions, for example, have several transitions which also correspond to the energy in the desired wavelength range. Species such as indium, antimony, and tellurium also have strong emission bands between 12 and 15 nm. These materials are mostly solid or liquid at room temperature, so that a supply into a discharge is much more complicated than in the case of a gas.

Various methods have been disclosed for supplying solid bodies or liquids to laser or discharge devices.

In WO-A-01/30 122, a mist of micrometric droplets is excited by a laser beam. The mist is generated by a liquid which is forced under pressure through a nozzle into a vacuum cylinder. It is particularly disadvantageous in this device that only liquid material can be used, and that comparatively large quantities of material are transported through the vacuum chamber of the radiation source. It is not possible, furthermore, to optimize the quantity of material during operation.

U.S. Pat. No. 5,991,360 describes a further device in which the material introduced into a low-pressure chamber is composed of a mixture of gas and solid particles, which is irradiated by a laser beam. The imperfect focusing of the continuously supplied material has a particularly negative effect on the conversion efficacy here. Here as well as in the preceding case, the distribution of the material density in the laser spot is naturally very wide. The optical illumination system can be contaminated owing to the comparatively large quantity of supplied material, in spite of an additional separation device. Re-absorption effects of the supplied mixture further reduce the intensity of the EUV radiation. In particular, the device has no possibilities for optimizing the supply of particles during operation.

U.S. Pat. No. 4,723,262 discloses a further device in which the material is supplied in the form of individual droplets into a vacuum chamber in synchronicity with the laser beam. The excitation of the liquid material is effected by laser beams, ions, or electrons, which excite the material into plasma formation. An additional device for recovering the excess material is to minimize a contamination of the optical illumination system. Since the droplet size is determined mainly by the surface tension of the liquid material, no further optimization of the quantity of material introduced into the radiation source is possible. The mercury used in this case has a comparatively high vapor pressure in the vacuum chamber, so that the optical system is inevitably polluted and the operational life of the device is limited. In particular the repetition rate, which is naturally limited by the respective mechanical components, is highly disadvantageous in view of the required output power of the radiation source for EUV lithography.

In WO 01/31678, so-termed microbodies with a diameter of 10 to 100 μm are used. An additional device removes the excess material from the plasma spot, said material being again synchronously provided. A device of very complicated construction is disclosed herein. It is particularly disadvantageous here that the microbodies for a high-power radiation source do not fully evaporate, so that residual material fragments of the radiation source remain behind for contaminating the optical illumination system. Furthermore, the material quantity of the microbodies cannot be adapted to the requirements during operation.

EP-1 109 427 discloses a device for the synchronous supply of liquid material into a plasma pinch of an electrical discharge device. No solid material can be used here, neither is a device present for controlling the quantity of liquid material for optimizing the power of the radiation source during operation.

The invention accordingly has for its object to provide a device for and a method of generating extreme ultraviolet and/or soft X-ray radiation by means of a plasma which reduce the contamination of an optical illumination system in a simple manner, i.e. by technically simple means, and which optimize the available radiation within a short time span.

According to the invention, this object is achieved in a device of the kind mentioned in the opening paragraph in that a device is provided for controlling at least a quantity of the material introduced into a radiation source.

It is important for the invention here that the quantity of material is adapted during the generation of the plasma such that mainly the intensity of the desired radiation is optimized.

A particularly advantageous device is obtained in that the material can be mixed with a carrier gas in a storage container. The quantity of material entering the radiation source can be varied in a simple manner, for example by means of the pressure of the carrier gas in this case.

Preferably, the device is constructed such that the quantity of the material can be controlled by the composition of the mixture in the storage container. The control of the concentration of the material is also capable of adapting the quantity of material to the requirements as regards the plasma formation in the radiation source.

A further embodiment of the invention is characterized in that a focusing device is arranged between the storage container and a vacuum chamber in communication with said container for generating and/or aligning a mass beam. The flow velocity of the material flowing through the focusing device can be satisfactorily influenced by a pressure difference between the storage container and the vacuum chamber. Such focusing devices are known, for example, from U.S. Pat. No. 5,270,542. The mass beam here has a comparatively slim material density distribution. The carrier gas is mainly removed, because no additional enveloping of the mass beam is necessary anymore, since the mass beam is already aimed at the plasma pinch in the radiation source.

To improve the instantaneous adaptation of the quantity of material further, the device for generating the plasma is constructed such that at least a blocking device for controlling the mass beam before it enters the radiation source is arranged in the vacuum chamber. The particular advantage of this feature lies in the lower inertia of the control of the quantity of material entering the radiation source and in the spatial separation between the dispensing of material and the radiation source.

To achieve a higher precision in the control of the quantity of material, it is useful to choose the construction of the device described above such that the blocking device comprises at least one disc with at least one void allowing the mass beam to pass and rotates controlled by a drive whose shaft extends substantially in the direction of the mass beam. This embodiment, which has a low mechanical inertia and is easy to manufacture, leads to a very exact control of the quantity of material so as to minimize further, for example, the re-absorption of EUV radiation and the pollution of the optical illumination system. The mass beam passing through the void corresponds to the operational position "open" of the blocking device. When the mass beam hits against the disc, by contrast, no material enters the radiation source any more. It is of particular advantage here that the blocking device and the radiation source are spatially separated from one another, so that no contamination of the optical illumination system by the separated material can take place.

In a particularly advantageous device, the blocking device is constructed such that the void in the disc takes the shape of at least one opening or one sector. The void may obviously take any shape whatsoever. In particular circular, rectangular, triangular, and trapezoidal openings may be mentioned by way of example here. Various void patterns are possible. A special embodiment comprises, for example, several voids in the form of sectors, similar to a marine screw, so as to deflect the blocked quantity of material.

Even more advantageous is the situation in which at least two discs are arranged one behind the other, which discs can be driven either jointly or separately. A continuous mass beam may be transformed into a pulsed beam thereby, whose pulse duration and frequency can be readily synchronized with the mode of operation of the radiation source.

Furthermore, the device may be constructed such that the portion of the mass beam blocked by the rotating disc can be sucked into a vacuum device. The blocked material can be prevented from entering the radiation source from the vacuum chamber thereby.

It is useful for the arrangement of the device described above that the vacuum device is arranged against the vacuum chamber and comprises a filter, a vacuum pump, and a return line connected to the filter and the storage container. The filter is capable of protecting the pump against contamination by the material, thus prolonging its operational life. The return line renders it possible to recycle the often expensive material such as, for example indium, gallium, or tellurium.

To improve the spatial separation between the vacuum chamber and the radiation source and to prevent unfocused gas and/or mass particles from entering, the device may be constructed such that a skimmer is arranged between the vacuum chamber and the radiation source. This skimmer skims off the final inhomogeneous edge regions of the mass beam, thus generating a reproducible, stable beam of particles.

The contamination of the optical illumination system can be reduced further in that a separator device is arranged at the radiation source opposite the skimmer. This achieves a separation of the material passing through the radiation source. The separator device may for this purpose be constructed as a cooling trap.

According to the invention, furthermore, the object as regards a method of generating extreme ultraviolet and/or soft X-ray radiation is achieved in that at least a quantity of the material is introduced in a controlled manner into a radiation source. An instantaneous supply of the material into a plasma in accordance with the requirements is provided thereby such that a contamination of the optical illumination system is avoided and the radiant efficacy is optimized.

Preferably, the method is designed such that the material comprises at least a solid and/or a liquid component. This renders possible a higher flexibility in the choice from those materials which have a high conversion efficacy for radiation in the wavelength range from 12 nm to 15 nm, particularly at 13.5 nm.

It is particularly advantageous for the method if the quantity of material is controlled through the supply of at least one carrier gas. This renders it possible to use also non-volatile materials, for example in the form of an aerosol.

It is provided in a further embodiment of the method that the carrier gas used is a rare gas or nitrogen. Rare gases are particularly inert and easy to handle, while nitrogen involves particularly low operational expenses and no recycling is necessary.

A further embodiment of the invention is characterized in that the quantity of material is divided into portions before entering the radiation source. The quantity of material may be readily controlled through a separation of a continuous flow of material, which is easy to implement.

A particularly advantageous method of controlling the quantity of material is designed such that the quantity of material enters the radiation source in the form of a pulsed mass beam. Thus a plasma can be generated in a pulsed operation so as to achieve, for example, a particularly efficient energy coupling into an electric discharge or alternatively to use a pulsed laser radiation.

A further advantage of the method may be that the material is introduced into the radiation source in the form of a beam of particles having a particle diameter in a range from 0.01 μm to 100 μm. The beam of particles may comprise, for example, very many particles of different sizes, the ratio of surface area to volume of the particles being very important for the efficacy of the plasma formation. If the particles have a large surface area, for example, a better absorption of the laser radiation will take place. Particles of small volume will evaporate more quickly, for example leading to a more complete plasma formation. The particles are preferably small, because the quantity of material can be better controlled then.

The method of generating the plasma may be modified such that a pulsed plasma is generated through the irradiation of at least one component of the mass beam by means of electrons, ions, or photons. The EUV radiation can be generated in a particularly simple manner by means of an electric discharge, but also by means of laser radiation.

The method is preferably designed such that the plasma formation and the entry of the mass beam into the radiation source are mutually synchronized. This renders it possible not only to reduce the contamination of the optical illumination system further, but also to reduce the material expenditure and thus the cost of operation.

A further embodiment of the method provides that the mass of the mass beam is separated in the radiation source. The contamination of the optical illumination system can be reduced and the operational life can be improved in particular in the case of a synchronous material supply into the radiation source, for example at the start of operations.

It is particularly advantageous for the method if a pulsed extreme ultraviolet and/or soft X-ray radiation is excited by the pulsed mass beam. The higher power levels of modem HCT pinch plasmas and pulsed laser sources as compared with continuous-wave lasers in particular improve the power of the radiation source in this manner, in particular for EUV lithography.

Figure 2:
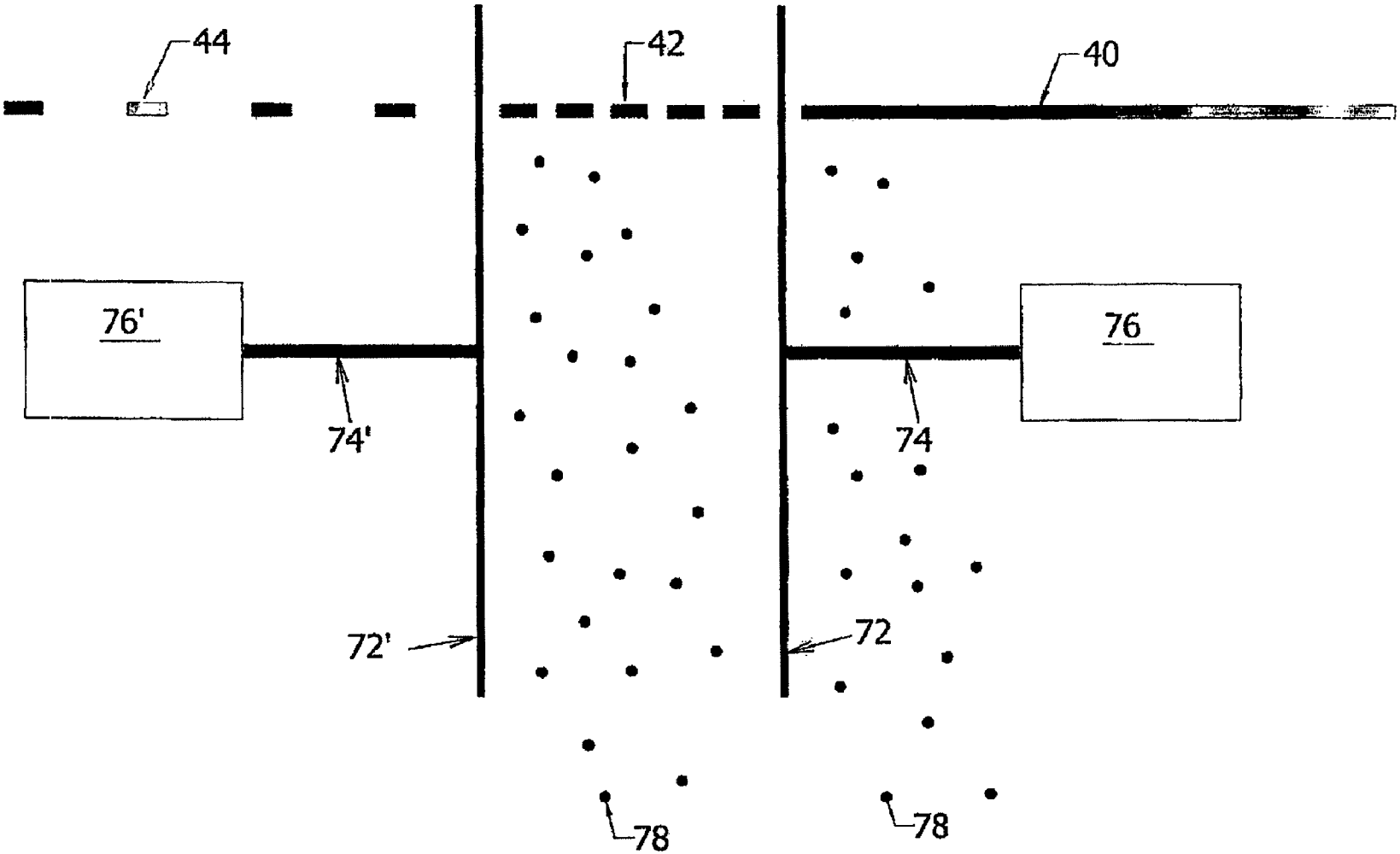
Figure 3:
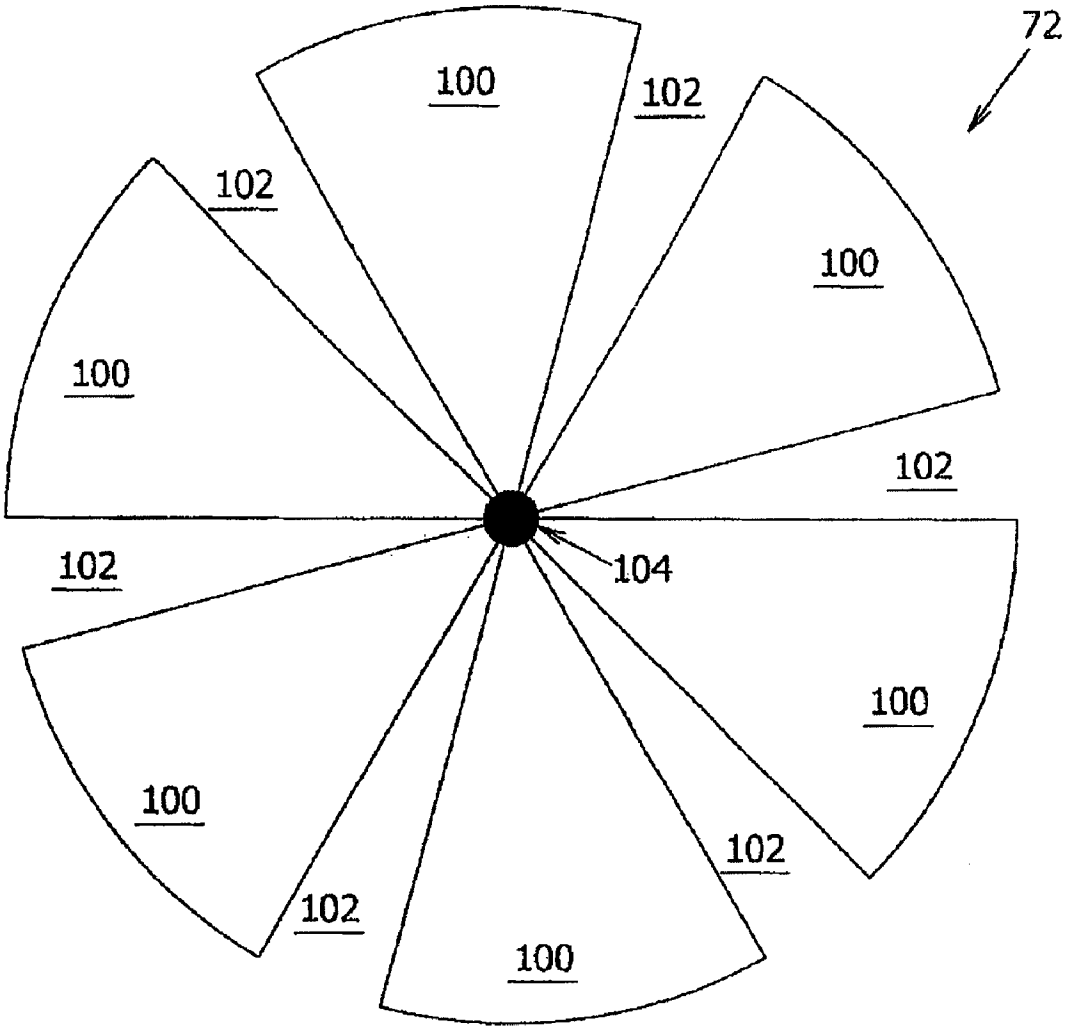

Further features and advantages of the invention will become apparent from the following description of an embodiment and from the drawings to which this description relates. In the drawing:

FIG. 1 diagrammatically shows a device according to the invention;

FIG. 2 diagrammatically shows a blocking device;

FIG. 3 diagrammatically shows a disc; and

Figure 4A:
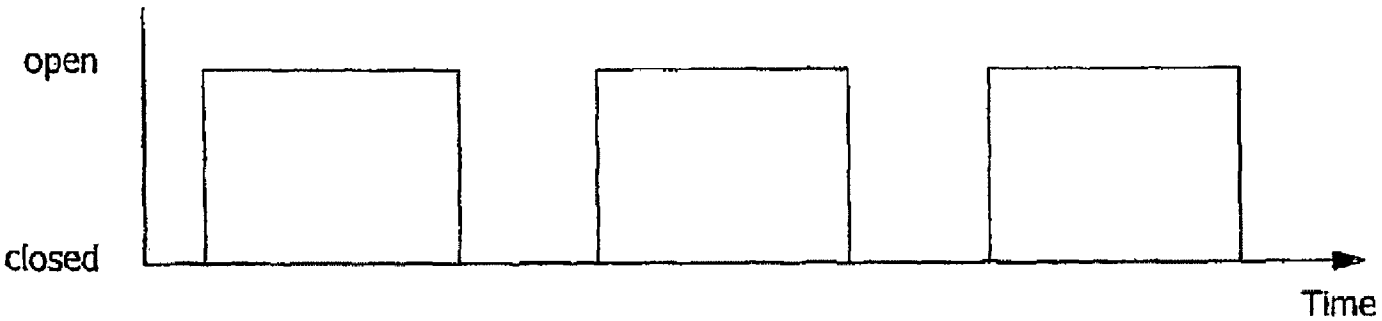
Figure 4B:
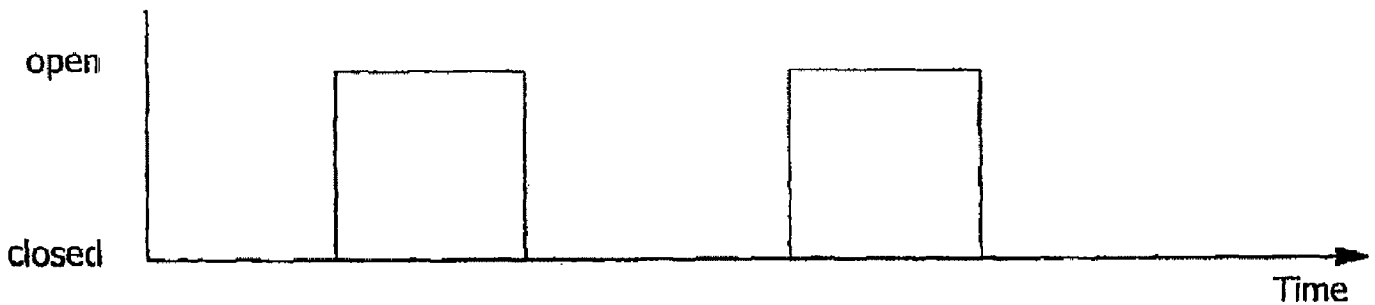
Figure 4C:
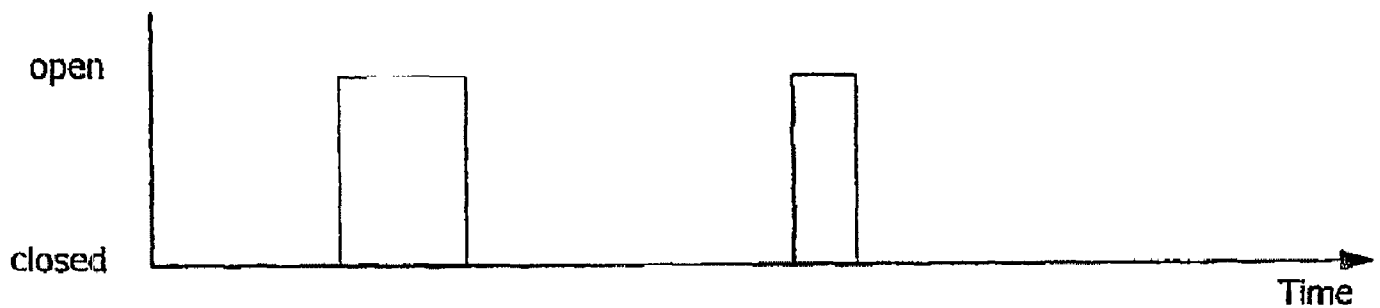

FIG. 4*a* plots the operational state of a first disc as a function of time;

FIG. 4*b* plots the operational state of a second disc as a function of time; and FIG. 4*c* shows the resulting operational state of a blocking device as a function of time.

The same constructional features always have the same reference symbols and always relate to FIGS. 1 to 4, unless stated otherwise below.

FIG. 1 shows the construction principle of a first embodiment of the invention. A mass material mixed with a carrier gas is present in a storage container 10. The quantity of the material eventually entering the radiation source 50 can be adjusted through variation of, for example, the partial pressure of the carrier gas or the concentration of the material in the storage container. Both solid and liquid materials having a high conversion efficacy for radiation in the range of, for example, extreme ultraviolet and/or soft X-ray radiation may be held in the storage container 10. In particular non-volatile materials may be mixed with a carrier gas in the storage container such that, for example, an aerosol is formed. The mixture passes through a focusing device 20 owing to the pressure difference with respect to the vacuum chamber 30. The focusing device aims the mass beam 40 at the blocking device 70 arranged in the vacuum chamber 30. Blocked material, excess material, and the carrier gas are removed by suction by means of a vacuum device arranged at the vacuum chamber 30, which device comprises a filter 14 and a vacuum pump 12. Expensive materials such as, for example, indium, gallium, germanium, or tellurium may in particular be returned through the return line 16 into the storage container 10 and may thus be recycled. The mass beam subdivided by the blocking device 70 passes through a so-termed skimmer 60 as a beam of particles into the voltage source 50 which is spatially separated from the vacuum chamber. This beam of particles has particle diameters in a range of 0.01 μm to 100 μm and forms a plasma 80 when irradiated with electrons, ions of an electric discharge, or photons of a laser beam. A separator device 90 which is to separate the material passing through the radiation source 50 is present opposite the inlet side for the beam of particles of the radiation source 50. The separator device 90 may be a cooling trap in practice, with the purpose of avoiding contamination of the optical illumination system (not shown) of the radiation source 50.

FIG. 2 shows the operating principle of the blocking device 70 in more detail. The focused continuous mass beam 40 shown on the right at the top hits against a first disc 72. This first disc 72 rotates about an axis which is parallel to the mass beam 40 and is driven by a first drive device 76 driven by a first shaft 74. Voids in the first disc 72 cause a first pulsed mass beam 42 to hit against a second disc 72', which in its turn is controlled by a second shaft 74' and a second drive device 76'. The material passing through the second disc 72' in the open state thereof forms a final pulsed mass beam 44. The material blocked by the discs 72, 72' is removed by suction through a vacuum device (not shown). The comparatively low masses of the discs 72, 72' render it possible to vary the quantity of material entering the radiation source instantaneously and in synchronicity with the preferably pulsed plasma formation.

FIG. 3 shows an embodiment of a disc 72. Closed sectors 100 and voids in the form of open sectors 102 are arranged here around a disc shaft 104 in alternation in clockwise direction. When the mass beam (not shown) hits against a closed sector 100, the disc 72 is in the closed operational state, so that the mass beam 40 cannot pass through. When a mass beam 40 meets the open sector 102, the disc 72 is in the open operational state, and the mass beam 40 can pass through.

FIG. 4*a* shows the operational states of a first rotating disc 72 of the blocking device 70 shown in FIG. 2 as a function of time.

FIG. 4*b* shows the operational states of the second disc 72' of the blocking device 70 shown in FIG. 2 as a function of time. The frequency and pulse durations of the final pulsed mass beam 44 can be controlled through variation of the size and shape of the void and the rotation velocity of the first and the second disc, as is shown in FIG. 2. In addition, the second disc 72' renders it possible to generate a phase shift, as is shown in FIG. 4*c*, one disc being sufficient for varying the frequency and pulse duration.

FIG. 4*c* shows the resulting operational state of the blocking device 70. The blocking device 70 here comprises two discs 72, 72' arranged one behind the other. The diagrams of FIGS. 4*a* and 4*b* show the corresponding "open" and "closed" positions of the two discs 72 and 72'. It is apparent from a simple comparison of FIGS. 4*a* and 4*b* that the diagram of FIG. 4*c* represents the effective "open" position for the mass beam 40. Viewing, for example, the first "open" positions shown on the left in FIGS. 4*a* and 4*b*, it can be ascertained that the start of the "open" position of FIG. 4*b* also is the start of the effective "open" position of FIG. 4*c*, while the end of the "open" position of FIG. 4*a* represents the end of the effective "open" position of FIG. 4*c*. The "open" positions of FIG. 4*c* accordingly show when and to what extent the mass beam 40 is allowed to pass through in a pulsed manner so as to enter the radiation source 50 as a pulsed or multiply pulsed mass beam 44.

An inventive device and method have been disclosed wherein the contamination of an optical illumination system is reduced and the power of the radiation that can be generated is instantaneously optimized through a control of the quantity of a material introduced into a radiation source.

LIST OF REFERENCE NUMERALS

10 storage container
12 vacuum pump
14 filter
16 return line
20 focusing device
30 vacuum chamber
40 mass beam
42 first pulsed mass beam
44 final pulsed mass beam
50 radiation source
60 skimmer
70 blocking device
72; 72' first; second disc
74; 74' first; second shaft
76; 76' first; second drive device
78 blocked material
80 plasma
90 separator device
100 closed sector
102 open sector
104 disc shaft

The invention claimed is:

1. A device for generating extreme ultraviolet and/or soft X-ray radiation, the device comprising:

means for generating a plasma through irradiation of a material, and means for controlling at least a quantity of the material that is introduced into a radiation source, wherein the means for controlling are configured to control a rotation of a disc having at least one void to control the quantity of the material that is introduced into the radiation source.

2. The device as claimed in claim 1, wherein the material is mixable with a carrier gas in a storage container.

3. The device as claimed in claim 2, wherein the quantity of the material is controlled by means of composition of the mixture in the storage container.

4. The device as claimed in claim 2, further comprising a focusing device arranged between the storage container and a vacuum chamber in communication with said storage container for generating and/or aligning a beam including a portion of the material.

5. The device as claimed in claim 4, further comprising a blocking device arranged in the vacuum chamber and including the disc for controlling the beam before the beam enters the radiation source.

6. The device as claimed in claim 5, wherein the disc has a shaft that extends substantially in a direction of the beam.

7. The device as claimed in claim 6, wherein the void in the disc has a shape of at least one opening or one sector.

8. The device as claimed in claim 6, further comprising a further disc arranged behind the disc, wherein the disc and the further disc are driven either jointly or separately.

9. The device as claimed in claim 6, wherein a portion of the beam blocked by the blocking device is sucked into a vacuum device.

10. The device as claimed in claim 9, wherein the vacuum device is arranged against the vacuum chamber and comprises a filter, a vacuum pump, and a return line connected to the filter and to the storage container.

11. The device as claimed in claim 4, further comprising a skimmer arranged between the vacuum chamber and the radiation source.

12. The device as claimed in claim 11, further comprising a separator device arranged at the radiation source opposite the skimmer.

13. A method of generating extreme ultraviolet and/or soft X-ray radiation comprising the acts of:

generating a plasma through irradiation of a material, controlling introduction of at least a quantity of the material into a radiation source by controlling a rotation of a disc having at least one void.

14. The method as claimed in claim 13, wherein the material comprises at least a solid and/or a liquid component.

15. The method as claimed in claim 13, wherein the quantity of material is further controlled through the supply of at least one carrier gas.

16. The method as claimed in claim 15, wherein the carrier gas used is a rare gas or nitrogen.

17. The method as claimed in claim 13, wherein the quantity of material is divided into portions before entering the radiation source.

18. The method as claimed in claim 13, wherein the quantity of material enters the radiation source in a form of a pulsed beam including a portion of the material.

19. The method as claimed in claim 17, wherein the pulsed beam is pulsed by a blocking device.

20. The method as claimed in claim 19, wherein the beam is pulsed in a multiple arrangement.

21. The method as claimed in claim 13, wherein the material is introduced into the radiation source in a form of a beam of particles having a particle diameter in a range from 0.01 μm to 100 μm.

22. The method as claimed in claim 13, the plasma is generated through irradiation of at least one component of the beam by means of electrons, ions, or photons.

23. The method as claimed in claim 13, wherein formation of the plasma and entry of a portion of the material into the radiation source are mutually synchronized.

24. The method as claimed in claim 13, wherein mass of a pulsed beam including a portion of the material is substantially separated in the radiation source.

25. The method as claimed in claim 24, wherein a pulsed extreme ultraviolet and/or soft X-ray radiation is excited by the pulsed beam.

26. A device for generating radiation comprising:

a radiation source;

a material source for supplying material to the radiation source for forming a plasma;

a disc having at least one hole; and disc drive configured to control a quantity of the material entering the radiation source by controlling a rotation of the disc.

27. The device of claim 26, wherein the disc drive is configured to synchronize entry of the quantity of the material into the radiation source with formation of the plasma.

28. The device of claim 26, wherein the disc drive is configured to provide a pulsed beam of the material and to synchronize at least one of a pulse duration and a frequency of the pulsed beam with a mode of operation of the radiation source.

29. The device of claim 26, further comprising a vacuum device configured to suck a blocked portion of the material prevented by the disc from entering the radiation source.

30. The device of claim 29, wherein the vacuum device includes a return line configured to return the blocked portion of the material to the material source for recycling.

31. The device of claim 26, further comprising a further disc having at least one further hole, wherein the disc and the further disc are rotated to change the quantity of the material entering the radiation source.

32. The device of claim 31, wherein the disc and the further disc are rotated at least one of jointly and separately.

* * * * *